United States Patent [19]

Llorente

[11] 4,079,689

[45] Mar. 21, 1978

[54] PARTIAL SECONDARY BARRIERS FOR SELF-SUPPORTING, AXI-SYMMETRICAL TANKS ON BOARD VESSELS

[75] Inventor: D. Tomás Velasco Llorente, Las Arenas (Vizcaya), Spain

[73] Assignee: Sener, Tecnica Industrial Y Naval, S.A., Las Arenas (Vizcaya), Spain

[21] Appl. No.: 703,851

[22] Filed: Jul. 9, 1976

[30] Foreign Application Priority Data

Jul. 10, 1975 Spain ..... 439.283

[51] Int. Cl.[2] ..... B63B 25/16

[52] U.S. Cl. ..... 114/74 A; 220/901

[58] Field of Search ..... 114/74 R, 74 A; 220/9 A, 9 LG, 15

[56] References Cited

U.S. PATENT DOCUMENTS

| | | | |
|---|---|---|---|
| 3,093,260 | 6/1963 | Macormack et al. | 220/15 |
| 3,319,431 | 5/1967 | Clarke et al. | 114/74 A |
| 3,461,678 | 8/1969 | Klipping et al. | 220/15 |
| 3,537,415 | 11/1970 | Jackson | 114/74 A |
| 3,547,301 | 12/1970 | Ffooks | 114/74 A |

*Primary Examiner*—Trygve M. Blix
*Assistant Examiner*—Stuart M. Goldstein
*Attorney, Agent, or Firm*—Fleit & Jacobson

[57] ABSTRACT

The invention relates to an improvement in partial secondary barriers for self-supporting, axi-symmetrical cargo tanks having a layer of thermal insulation thereon, the cargo tanks mounted on board marine vessels having a double-bottom construction with an inner shell by means of an annular support supporting the cargo tank of the vessel. The improvement in the partial secondary barrier comprises a secondary barrier tank, preferably cylindrical in shape. The secondary barrier tank is installed under each cargo tank wherein the cross-section of the secondary barrier tank is substantially less than the maximum horizontal cross-section of the cargo tank. The barrier tank, in one embodiment, is structurally joined to the inner shell of the double bottom of the vessel. The tank comprises a stiff external wall, and internal thermal insulation, and an inner impermeable layer for withstanding the low temperatures of the liquid being collected in the secondary barrier tank. Leak drainage pipes originating from the interface of the thermal-insulation with the cargo tank extend into the tank for draining off any leak that may occur in the cargo tank. Collected leaking liquid can be discharged from the secondary barrier tank.

9 Claims, 6 Drawing Figures

FIG.2
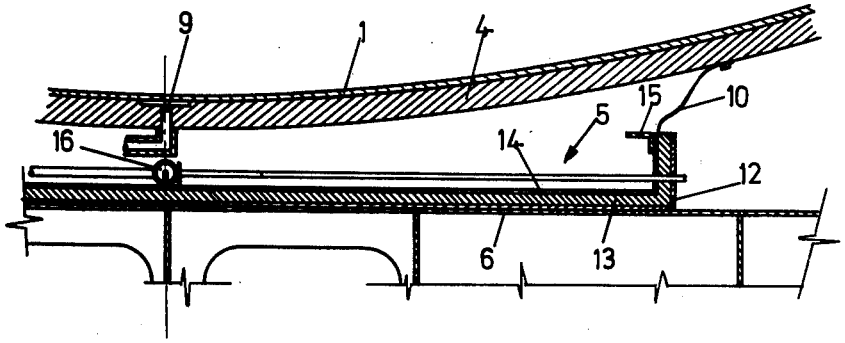
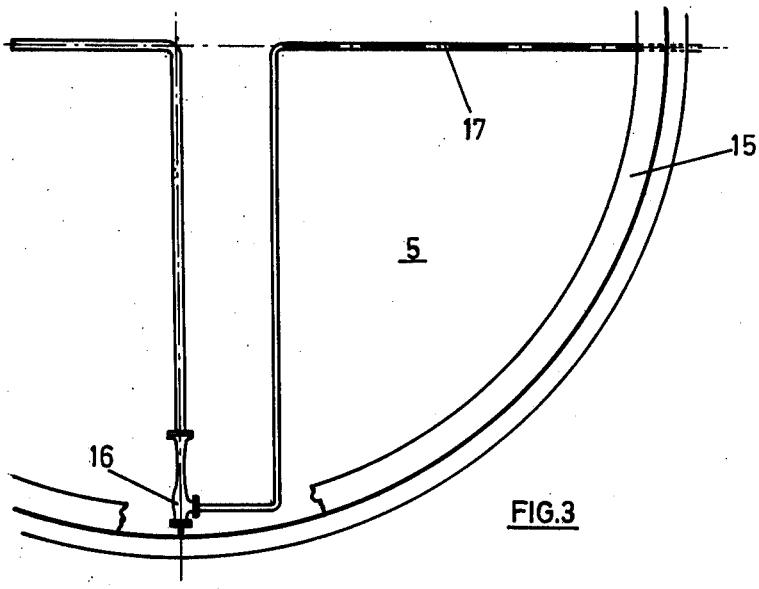
FIG.3

FIG. 5
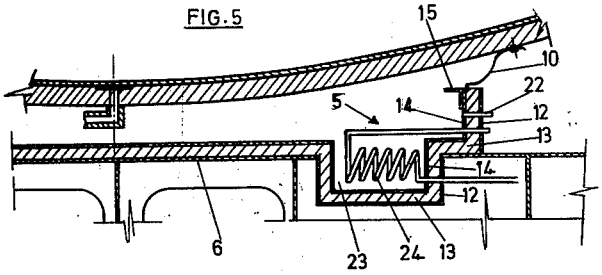
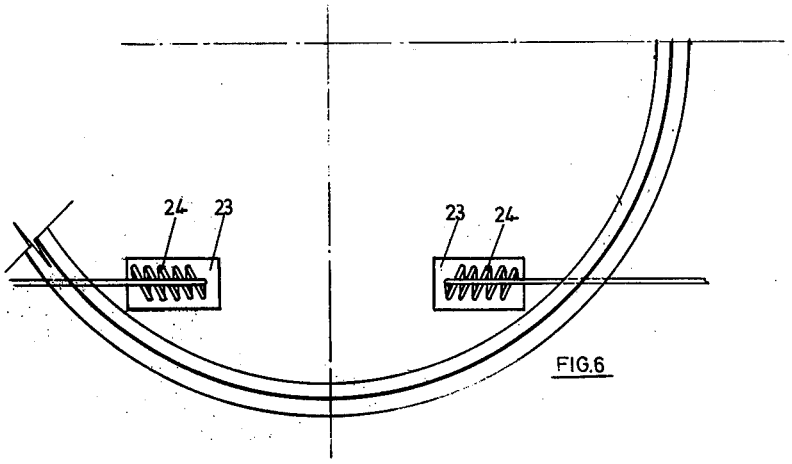
FIG. 6

PARTIAL SECONDARY BARRIERS FOR SELF-SUPPORTING, AXI-SYMMETRICAL TANKS ON BOARD VESSELS

BACKGROUND OF THE INVENTION

The present invention improves the partial secondary barriers for self-supporting cargo tanks, of vertical axis, axi-symmetrical body shape, to be used on board marine vessels.

The invention is applicable to cargo tanks with any axi-symmetrical shape, with vertical axis, such as a sphere or a cylinder, with spherical or ellipsoidal heads, or a combination of these geometric shapes. All these cargo tanks are mounted on the structure of the said vessels by means of an annular support, joined at its lowermost edge to the vessel's structure and at its uppermost edge to the cargo tank wall; it being also possible for the support to form part of the cargo tank wall in the area where the two join.

Axi-symmetrical cargo tanks of the types mentioned above are especially suited for storing and/or transporting liquefied gases, either at high pressure, or at a pressure slightly above atmospheric. This is due to the fact that their relatively simple geometric form, and the absence of reinforcements that would interrupt the homogeneity of the cargo tank shell, make possible the precise calculation of the stresses at any point on the cargo tank and for any load condition.

All these factors result in increasing the accuracy of the design to such an extent that, for axi-symmetrical cargo tanks whose design is based on the above mentioned type of precise stress analysis, the Classification Societies and other regulatory bodies, permit their construction on board marine vessels. The only requirements are that a partial secondary barrier be provided to contain whatever small leaks that might occur, over a period of about two weeks, as a result of the appearance of cracks of low magnitude, while a complete secondary barrier is required for the other types of tanks transporting liquefied gases.

The possibility of partially eliminating the aforementioned secondary barrier, with the resulting savings in construction costs, is particularly attractive when axi-symmetrical cargo tanks, of the types already mentioned, are used for the marine transport of liquefied natural gas, ethylene, propane, propylene, butane, butadiene, isobutane, ammonia, chrorine and other products which are carried at pressure slightly above atmospheric. This is especially true in those cases where the product to be transported has a very low boiling point, as it is the case for liquefied natural gas carried at −162° C, for ethylene carried at −104° C, and for those liquefied petroleum gases which are transported at a temperature between −40° C and −50° C. In all these cases the cargo tanks are thermally insulated to avoid an excessive evaporation of the product being transported.

One of the methods most commonly used at present to provide a partial secondary barrier consists of lining the hull of a ship, in the zone below the cargo tank with an insulation material that has been covered with a thin metallic sheet capable of withstanding the low temperature of the cargo.

This system has the disadvantage that its construction must take place on board ship and cannot be carried out simultaneously with other work to be done such as hull construction or the assembly of the cargo tanks and their supports. Another drawback of this system is that it requires the insulation of a large area of the hull, thereby increasing the cost of the ship. It also does not prevent cold vapors from the leaking liquid from coming into contact with structural elements of the ship that are made of a quality of steel that is not designed for low temperatures and, moreover, is not thermally insulated.

As is well known, and due to the irregularities of the external surface of the cargo tank wall, there exist interstices of gaps between said surface and the internal surface of the thermal insulation around the cargo tank and along which possible leaks of liquid cargo can travel. Any leak, that occurs at a point on the cargo tank where no such interstice exists, will exert pressure on the thermal insulation and extend over the outer shell of the cargo tank until it reaches an interstice or gap where it can flow freely.

Leaks produced in the tank, above the area where the annular support connects with cargo tank, flow to the vicinity of this zone where pipes are placed to drain off any such leaks. In the area of the cargo tank below the connecting zone with the support, the leaks flow to the lowermost part of the cargo tank where, again, pipes have been placed to collect them. Moreover, there exists in the thermal insulation, in the zones of the tank where drainage pipes are located, a cavity which acts as a collector for the leaks coming from different areas of the cargo tank surface. The pipes coming from both hemispheres of the cargo tank deposit the liquid on the insulation covering the vessel structure in the area below the cargo tank.

The main objective of the present invention is to provide a secondary barrier, for axi-symmetrical cargo tanks of the types already described, whose construction will not interfere with either the construction of the cargo tank or the vessel, or the installation of the cargo tank in the vessel's hull.

Another objective of the invention is to provide a secondary barrier of simple construction and reduced dimensions, when compared to existing secondary barriers, and whose installations on board the vessel will be easily accomplished; all of which will result in a sizeable cost reduction, both for the secondary barrier and the vessel as a whole.

Still another objective of the invention is to provide a secondary barrier that will prevent any structural element of the vessel from coming into contact with either liquid leaking from the cargo tank or the vapors produced by such leaks.

Finally, an objective of this invention is also to provide a secondary barrier that will permit the leaking liquid to be easily disposed of, either in liquid form or in the form of vapors that can be vented to the atmosphere or be used, for example, in the vessel's boilers.

Accordingly, in the present invention, the partial secondary barrier is made up of a tank, preferably cylindrical in shape, whose section is substantially less than the maximum horizontal section of the cargo tank and which is installed below each cargo tank and structurally joined to the inner shell of the double bottom of the vessel.

This tank is made up of a stiff outer wall, an inner thermal insulation and finally, an impermeable layer capable of withstanding the low temperatures of the liquid being collected.

The manner in which the internal insulation is applied makes it possible for the outer wall of the tank to be constructed of normal quality steel. The inner, impermeable layer may consist, for example, of a thin sheet of aluminium.

This tank, which forms the secondary barrier of the present invention, is capable of collecting the leaks from the cargo tank and at the same time fully containing the vapors from the liquid being collected, so that, as a result, there does not exist any danger that a structural element of the vessel will be exposed to the cold vapors from a cargo tank leak.

The inner shell of the double bottom of the vessel may act as the lower base for the lateral external walls of the tank, inside which will be applied the thermal insulation and finally the impermeable inner layer.

The pipes that collect whatever leaks that may occur, discharge into the interior of the tank which constitutes the secondary barrier.

This tank, which constitutes the secondary barrier, may be constructed without an upper cover. In such a case, the walls of the tank are extended upwards to within a short distance from the outer surface of the insulation covering the cargo tank. In the space between the upper edge of the wall of the said secondary barrier tank and the external surface of the said cargo tank, a flexible skirt is installed which may, for example, be a laminated compound made of polyester film and aluminium foil. This skirt prevents the escape of the vapors from the liquid that are being collected and absorbs the thermal expansions and contractions of the cargo tank. If such a flexible skirt is used, then the leak drainage pipes, that originate from points below the area where the cargo tank wall and the annular support connect, have their discharge openings in the zone within the above mentioned flexible skirt. The leak drainage pipe that originate from points situated above the area where the annular support connects with the cargo tank wall, enter the secondary barrier tank through its lateral walls and discharge inside the tank.

In the event that the tank which constitute the secondary barrier is a completely closed structure, all the leak collecting pipes enter the tank through its lateral walls. Moreover, in this case, the pipe or pipes that originate from points on the thermal insulation below the area where the annular support connects with the cargo tank wall will be fitted with expansion joints capable of absorbing the thermal contractions and expansions of the cargo tank.

The tank which constitutes the secondary barrier will be equipped with the means for discharging of the leaked liquid collected.

These means of discharging could consist for example, of an ejector installed inside the secondary barrier tank and activated by one of the discharge pumps of the cargo tank.

The discharging of the leaked liquid collected in the secondary barrier tank may also be accomplished by injecting a warm gas, such as nitrogen, into the tank thereby causing the collected liquid to evaporate. The vapors produced by this evaporation would then be either vented to the atmosphere, sent to the ship's boilers, or burned in a catalytic burner.

The evaporation of the liquid in the tank could also be achieved by installing one or more coils inside the tank and through which a warm fluid would be circulated. The vapors thereby produced, as in the aforementioned case, would then be vented to the atmosphere or sent to the ship's boilers.

In the bottom of the secondary barrier tank one or more sump wells can be installed. For example, two sump wells can be located symmetrically with respect to the center longitudinal plane of the ship in the aft part of the secondary barrier's base. These sump wells will coincide with and fit into two cavities already present in the inner shell of the double bottom of the vessel.

The sump wells in the secondary barrier tank serve to centralize the liquid being collected, to increase the capacity of the tank, and, finally, to provide a location for the installation of the previously mentioned ejectors and coils (or pipes for injecting warm gases).

The basic design and characteristics already presented, as well as others particular to the invention will be more clearly defined by the following description which is based on, and refers to, the attached drawings. These drawings show, in schematic form, various methods of construction which are given only as examples and in no way limit other possible variations.

BRIEF DESCRIPTION OF THE DRAWINGS

FIG. 2 — a detail drawing at larger scale of the secondary barrier tank shown in FIG. 1.

FIG. 3 — a plan view drawing of FIG. 2.

FIGS. 5 and 6 — sectional and plan views of another alternate construction method for the secondary barrier tank.

DETAILED DESCRIPTION OF THE DRAWINGS

Figure 1:
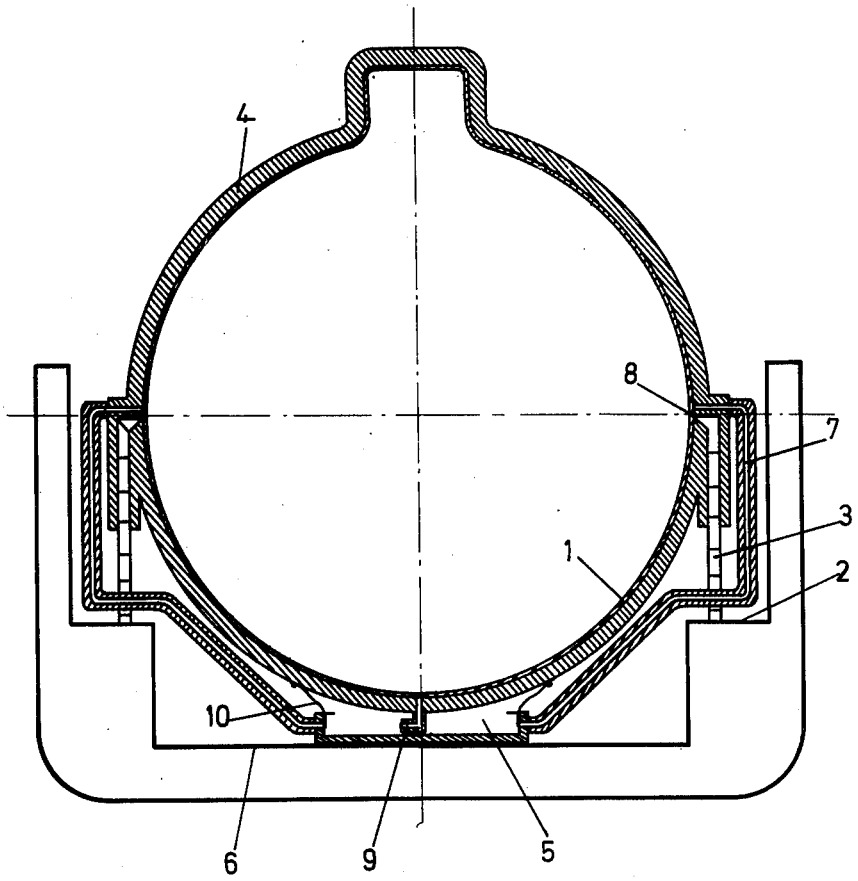
FIG. 1 — a schematic diametric section showing a construction method of the tank which constitutes the secondary barrier, installed below a spherical cargo tank in a ship.

In FIG. 1 a cargo tank 1 is presented, which is supported by the ship's structure 2 through the peripheral support 3. This support is connected at its lowermost edge to the ship's structure 2 and at its uppermost edge to the cargo tank 1. The support itself can be a part of the tank wall. The support 3 surrounds the cargo tank 1.

The cargo tank 1 is fully covered externally with a layer 4 made of a thermal insulating material.

According to the invention the secondary barrier comprises a tank 5, of cylindrical shape in the described example, which is structurally joined to the inner shell 6 of the ship's double bottom.

As has been mentioned previously, leaks that are produced in the wall of the cargo tank 1, run between the external surface of this wall and the internal surface of the thermal insulation 4 through the gaps or channels present between both surfaces due to the irregularities of the external surface of the cargo tank 1.

The leaks produced in the upper hemisphere of the cargo tank will travel down the tank wall until they reach the connection zone of the tank and the support 3. The leaks produced in the lower hemisphere will travel down the tank wall until they reach the lower pole of the cargo tank.

The draining of the upper hemisphere leaks will be performed by means of a plurality of pipes 7 which come from the internal surface of the thermal insulation 4 near the connection zone between the tank and its support. These tubes 7 are thermally insulated and discharge into the interior of the tank 5.

The leaks from the lower hemisphere are drained by means of one or more tubes 9 fitted in the lower pole or near this point. This tube 9 will also come from the internal surface of the thermal insulation 4, discharging into the interior of the tank 5. The tube 9 shall be thermally insulated.

The tank 5 constituting the secondary barrier is totally closed so as to avoid the liquid leakage or its vapor to come in contact with the ship's structure.

As it is shown in FIGS. 1, 2 and 5 the tank 5 may have no upper cover. In this case the lateral wall of said tank extends vertically up to the proximity of the thermal insulation 4 of the cargo tank 1. The gap between the lateral wall of tank 5 and the external surface of the thermal insulation 4 is closed by means of a flexible skirt 10 joined at its uppermost edge to the thermal insulation 4 and at its lowermost edge to the tank 5.

Figure 4:
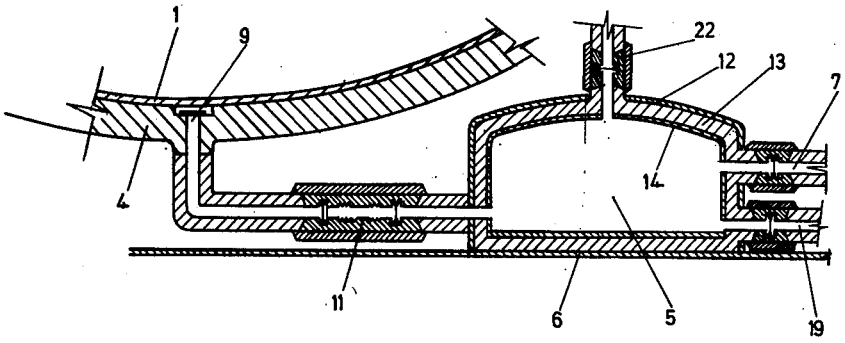
FIG. 4 — a view similar to FIG. 2, showing another alternate construction method.

As it is shown in FIG. 4 the tank 5 may be totally closed. In this case the pipe 9 conducting the leaks produced in the lower hemisphere of the cargo tank 1 to the tank 5, is provided with an expansion joint 11 able to absorb the thermal contraction of the tank 1.

In order to avoid lifting the cargo tank 1 to install tank 5, the tank 5 can be mounted slightly displaced from the longitudinal centre plane of the ship, in a zone below the cargo tank 1 that provides ample space.

In addition to avoiding the contact between any element of the ship's structure and the liquid leak or its cold vapor, the secondary barrier made according to the present invention has the additional advantage of decreasing, with reference to the existing designs, the dimensions of said barrier, as well as permiting its construction and installation independently or the work performed on the ship's hull and on the cargo tanks.

The tank 5 will be constituted, as shown in FIGS. 2, 4 and 5, by a resistant outer wall 12, an intermediate thermal insulation 13 and an internal lining 14. This lining shall be impermeable to the liquid and able to support the low temperatures of the liquid.

In this way the outer wall is thermally insulated from the liquid collected inside tank 5, and so it may be made of a normal quality steel.

As it is shown in FIGS. 4 and 5, outer wall 12 may not have a lower base. In this case the inner shell of the double-bottom acts as a lower base.

As it is shown in FIGS. 2 and 5 in the case the tank 5 has no upper cover, a deflecting annulus 15 is provided. This annulus may be made of the same material as the impermeable lining 14 and it is joined to this lining. The purpose of such annulus is to avoid the liquid picked up in the tank 5 to pound against the flexible skirt 10 when there is agitation in the liquid due to the movements of the ship.

The flexible skirt 10, as it is shown in FIGS. 2 and 5, may be fixed to the wall of the tank 5 by inserting its lowermost edge between the impermeable internal lining 14 and the intermediate thermal insulation 13. The internal lining 14 may be made of aluminum alloy or nickel steel, which makes impermeable the thermal insulation 13 and withstands the low temperatures of the liquid collected in the tank 5.

In the arrangement shown in the FIGS. 1, 2 and 5, the pipe 9 is placed within the space limited by the tank 5 while in the arrangement shown in the FIG. 4 the pipe 9 as well as the pipes 7 penetrate the wall of the tank 5 to discharge the liquid leaks from the cargo tank 1.

The drainage of the liquid collected in the tank 5 may be performed for example, as it is shown in the FIGS. 2 and 3, by means of one or more ejectors 16, placed inside the tank 5.

The activating liquid of each ejector 16 may be the liquefied gas carried on board. The activating liquid enters the ejector through the pipe 17 that penetrates the lateral surface of the tank 5, and is connected to the discharge of one of the discharge or cool-down pumps of the ship. The drainage of the liquid collected in the tank 5 may be also performed, as it is shown in FIG. 4, by injecting nitrogen gas at ambient temperature through one or more tubes 19. The resulting mixture of this nitrogen gas and the vapours produced by the liquid vaporization, is discharged through one or more pipes 22 that penetrate the lateral surface or the upper cover of the tank 5.

As an alternative arrangement, the bottom of the tank 5, as it is shown in FIGS. 5 and 6, has two sump wells 23 located symmetrically with respect to the longitudinal central plane of the ship and positioned towards the aft part of the tank.

These sump wells contribute to reduce the height of the tank 5 and being used to accommodate the ejectors or to accept the entrance of the nitrogen gas.

The vaporization of the liquid collected in the tank 5 may also be performed by means of coils 24 that can be placed in the sump wells 23 and through which a fluid is circulated at a convenient temperature. The tank 5 has an outlet pipe 22 for exhausting the vaporized liquid which can be led directly to the atmosphere or to the ship's boilers to be used as fuel.

In order to form the sump wells 23, the inner shell 6 of the double bottom has to be formed to conform in shape to the sump well, as does the rest of the tank 5. That is, it is necessary to provide an internal wall 12, an intermediate thermal insulation 13 and an impermeable internal lining 14 able to withstand the low temperatures of the liquid. The external wall 12 of the sump wells 23 of the tank 5 may be formed by a recess of the inner shell of the double bottom.

What we claim is:

1. An improvement in partial secondary barriers for self-supporting, axi-symmetrical cargo tanks having a layer of thermal insulation thereon, said cargo tanks mounted on board vessels having a double bottom construction with an inner shell, by means of an annular support supporting the cargo tank on the vessel, wherein the improvement comprises a closed secondary barrier tank means, preferably cylindrical in shape, said secondary barrier tank means being installed under each insulated cargo tank, wherein the cross-section of the secondary barrier tank means is substantially less than the maximum horizontal cross-section of the cargo tank, said secondary barrier tank means being structurally joined to the inner shell of the double bottom of the vessel and being structurally independent of said cargo tank, said secondary barrier tank means comprising a stiff external wall, an internal thermal insulation attached to the inside of said wall and an inner impermeable layer means attached to said internal thermal insulation for withstanding the low temperatures of liquid collected, leak drainage pipe means originating from the interface of the layer of thermal insulation with the cargo tank and extending into the secondary barrier tank means for draining off any leaks that may occur in the said cargo tank, and means for discharging the collected leaking liquid from the secondary barrier tank means.

2. The improvement as claimed in claim 1, wherein said secondary barrier tank means includes a secondary barrier tank open at its upper surface and said secondary barrier tank being installed so that said open upper surface is positioned a short distance from the external surface of the thermal insulation of the cargo tank, a flexible skirt means for joining the upper surface of said secondary barrier tank to the external surface of the thermal insulation of the cargo tank to close said secondary barrier tank, said leak drainage pipe means including first leak drainage pipes extending from the interface of the thermal insulation at a point below the annular support for the cargo tank, said first leak drainage pipes extending inside said barrier tank means from the interface of the thermal-insulation with the cargo tank, below the area where the annular support connects with the cargo tank.

3. The improvement as claimed in claim 1, wherein said secondary barrier tank means includes a closed secondary barrier tank and orifice means, said leak drainage pipe means including leak drainage pipes extending from said origin of said leak drainage pipe means to said orifice means and expansion joint means associated with at least one of said leak drainage pipes for absorbing the thermal expansions and contractions of the cargo tank.

4. The improvement as claimed in claim 1, wherein said secondary barrier tank means includes a secondary barrier tank having a double bottom wall and said inner shell of the double bottom of the vessel acts as the lower wall of the double bottom wall of the secondary barrier tank.

5. The improvement as claimed in claim 1, wherein said means for discharging the collected leaking liquid in the secondary barrier tank means comprises at least one ejector.

6. The improvement as claimed in claim 1, wherein said secondary barrier tank means includes a secondary barrier tank having a first opening, means for injecting warm gas through said first opening into said barrier tank for causing the evaporation of the collected leaking liquid, a second opening, and means for discharging the resulting mixture of the vaporized liquid and the injected gas through said second opening.

7. The improvement as claimed in claim 1, wherein said secondary barrier tank means includes a secondary barrier tank having an internal coil means having a coil and means for circulating a warm fluid through said coil for evaporating the leaked liquid collected in the secondary barrier tank and wherein said secondary barrier tank further includes a discharge means for discharging said evaporated liquid.

8. The improvement as claimed in claim 1, further comprising at least one sump well formed in the bottom of said secondary barrier tank means, said sump well equipped with means for discharging the collected liquid.

9. The improvement as claimed in claim 2, wherein said leak drainage pipe means further comprises second leak drainage pipes extending from the interface of the thermal insulation at a point near the annular support for the cargo tank and above the annular support for the cargo tank, said second leak drainage pipes extending inside said barrier tank.

* * * * *